US006479446B1

(12) United States Patent
Sherry et al.

(10) Patent No.: US 6,479,446 B1
(45) Date of Patent: Nov. 12, 2002

(54) AQUEOUS CLEANING COMPOSITIONS IN DISPERSED LAMELLAR PHASE

(75) Inventors: Alan Edward Sherry, Cincinnati, OH (US); Jeffrey Lawrence Flora, Mason, OH (US); Jason Michael Knight, Cincinnati, OH (US); Zuchen Lin, Midland, MI (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/555,355

(22) PCT Filed: Nov. 24, 1998

(86) PCT No.: PCT/US98/24908

§ 371 (c)(1),
(2), (4) Date: May 26, 2000

(87) PCT Pub. No.: WO99/27066

PCT Pub. Date: Jun. 3, 1999

Related U.S. Application Data

(60) Provisional application No. 60/066,563, filed on Nov. 26, 1997.

(51) Int. Cl.[7] ..... C11D 1/86; C11D 3/39; C11D 3/43

(52) U.S. Cl. ..... 510/238; 510/367; 510/372; 510/405; 510/417; 510/418; 510/422; 510/506

(58) Field of Search ..... 510/119, 123, 510/124, 125, 128, 130, 199, 235, 237, 238, 367, 372, 405, 422, 470, 499, 506, 417; 442/84; 422/28

(56) References Cited

U.S. PATENT DOCUMENTS

| | | | | |
|---|---|---|---|---|
| 5,707,952 | A | * | 1/1998 | Lambremont et al. |
| 5,861,367 | A | * | 1/1999 | Blanvalet et al. |
| 5,891,392 | A | * | 4/1999 | Monticello et al. |

FOREIGN PATENT DOCUMENTS

| | | | |
|---|---|---|---|
| EP | 0 328 174 A2 | 8/1989 | ..... C11D/3/43 |
| EP | 0 414 549 A2 | 2/1991 | ..... C11D/17/00 |
| WO | WO 95/33024 | 12/1995 | ..... C11D/1/04 |

* cited by examiner

*Primary Examiner*—Gregory E. Webb
(74) *Attorney, Agent, or Firm*—Robert B. Aylor; Jason C. Camp; Kevin L. Waugh

(57) ABSTRACT

Compositions described herein are aqueous detergent compositions, preferably hard surface cleaning compositions, which contain a flexible lamellar sheet phase dispersed in the aqueous phase. The compositions are viscous, provide excellent soap scum and hard water properties and are easy to rinse. Such compositions are formulated by using an alkylaryl detergent composition in combination with an alcohol and/or cationic surfactant, together with a hydrotropic solvent, in an acidic system further optionally comprising a peroxide.

18 Claims, No Drawings

AQUEOUS CLEANING COMPOSITIONS IN DISPERSED LAMELLAR PHASE

This application claims benefit Ser. No. 60/066,563 filed Nov. 26, 1997.

FIELD OF THE INVENTION

This invention relates to liquid detergent compositions for use in cleaning hard surfaces, particularly bathroom surfaces. Such compositions typically contain detergent surfactants, solvents, builders, etc.

BACKGROUND OF THE INVENTION

The use of solvents and organic water-soluble synthetic detergent surfactants for cleaning hard surfaces is well established. Known liquid detergent compositions comprise organic cleaning solvents, detergent surfactants, and optional detergent builders and/or abrasives.

Liquid cleaning compositions have the great advantage that they can be applied to hard surfaces in neat or concentrated form so that a relatively high level of, e.g., surfactant material and/or organic solvent is delivered directly to the soil. Therefore, liquid cleaning compositions have the potential to provide superior soap scum, grease, and oily soil removal as compared to dilute wash solutions, e.g., those prepared from powdered cleaning compositions.

It is often desirable to raise the viscosity of liquid hard surface cleaners. Higher viscosity can allow for more specific dispensing of the product during use. Also, higher viscosity can promote better action of the product on non-horizontal surfaces, such as toilets, bath tubs, shower and the like. Enhanced surface cling and coverage allows for improved cleaning action of the surfactant/solvent system. A product with shear-thinning viscosity is particularly preferred because it can be packaged and sold either as a spray or liquid product, is easy to use, and can deliver good cling and coverage on surfaces. These are important product attributes that limit the amount of product wasted, during use, through dripping. Additionally, a viscous, shear-thinning liquid product can be less irritating in-use and can be perceived as milder. Viscosity and shear-thinning properties can be obtained via methods known in the art, such as the use of shear-thinning gums or polymers. However, thickeners, such as gums or polymers have drawbacks in that they raise formula cost, yet provide only one benefit, thickening. They do not participate in the actual cleaning of the surface and therefore represent "inert" materials. In many cases, these polymers leave streaks and films on surfaces, and are often not shear-thinning enough to be useful in spray bottle applications.

Preferably, viscosity is built by a "self-thickening" system wherein the surfactant/solvent actives in the composition are used to provide viscosity. Such an approach has several advantages versus polymeric thickeners. First, surfactant/solvent systems are often more economical than polymers. Second, the surfactants/solvents can provide a dual benefit by providing both viscosity and cleaning. Thickening polymers tend to compete for surface sites and can inhibit the action of the cleaning system. Third, judicious selection of surfactants/solvents allows for improved compatibility at acidic pH and/or with optional additives, such as peroxide. Many polymeric thickeners are either ineffective at a pH below 4, or are not compatible with optional actives such as peroxide. Finally, the residues of surfactants tend to be more easily rinsed away.

It is known in the art how to formulate self thickened compositions where the thickening is achieved without the use of polymeric thickeners, see for instance, EP 518 401 and EP 21 581, incorporated herein by reference. However, for many purposes these particular non-polymer thickened approaches are not desirable, since the viscosity is obtained at the expense of producing compositions that display very stable foams, leading to rinsing difficulties. This was addressed by WO95/33024, incorporated herein by reference, via the use of a combination of amine oxide and secondary or primary mono-branched alkyl sulfate or sulfonate surfactants in acidic media. Limitations of this approach are that it requires a specific choice of surfactant, and desirable viscosities are not achieved unless the product has a pH greater than 3, thus limiting the scope of hard water removal efficacy. Additionally, it has been discovered that the compositions of the present invention can incorporate higher levels of hydrotropic solvent, leading to improved soap scum removal, while still preserving the desired viscosity profiles. Compositions that are chemically similar to those of the present invention but do not predominantly exhibit a flexible lamellar phase structure do not provide the same level of cleaning. While not wishing to be limited by theory, it is believed that the lamellar structure provides a better coverage and/or more surfactant contact with the soil.

The present invention provides viscous acidic hard surface cleaning compositions suitable for removal of soils commonly encountered in the bathroom, said compositions being made viscous by means of a self thickening system, but which are nevertheless easy to rinse. These acidic hard surface cleaning compositions remove soap scum and hard water marks. The invention can provide viscous acidic hard surface cleaning compositions with shear-thinning properties suitable for dispensing out of either spray or liquid packages and which are non-irritating in use. The compositions can have disinfectant properties achieved through the choice of actives, including citric acid and cationic surfactants, and can be used with or without additives such as hydrogen peroxide for additional mold/mildew prevention benefits.

SUMMARY OF THE INVENTION

The hard surface detergent cleaning compositions herein are predominantly in the form of flexible lamellar sheets dispersed in an aqueous phase. Such compositions provide excellent soap scum cleaning; good hard-water-soil removal properties; low levels of suds; and excellent rinsing characteristics. The product viscosity is provided by shear-thinning rheology achieved through phase chemistry, specifically the formation of lamellar surfactant sheets dispersed in the aqueous phase. The invention relates more particularly to aqueous detergent compositions that comprise:

a. from about 1% to about 5% alkyl aryl sulfonate detergent surfactant;

b. from about 0.3% to about 2% nonionic alcohol and/or cationic surfactant;

c. from about 1% to about 8% of one, or more, hydrotropic solvents;

d. optionally, an effective amount, up to about 5% hydrogen peroxide; and e. the balance an aqueous solvent system, and wherein the cleaning compositions predominantly comprise flexible lamellar sheets dispersed in an aqueous phase and have a pH from about 0.5 to about 6.

The flexible lamellar sheets comprising surfactant provide viscosity and improved cleaning. It is believed that the improved cleaning is a direct result of the lamellar sheets, since the lamellar structure allows for more surfactant contact with the soil.

DETAILED DESCRIPTION OF THE INVENTION

The compositions of the invention are especially useful for cleaning soils that are commonly encountered in the bathroom. These include dust particles, hard water stains, fatty acids, triglycerides, lipids, insoluble fatty acid soaps, and the like. The detergent compositions can be used on many different surface types, such as ceramic, Fiberglas, polyurethane, and plastic surfaces.

A. The Alkyl Aryl Sulfonate

Alkyl aryl sulfonates are an essential component of the invention. Suitable alkyl aryl sulfonates can be neutralized with any alkali metal such as lithium, sodium, potassium and the like, or can alternatively be neutralized with an ammonium or $C_1$–$C_9$ ammonium salt derivative such as monoethanol amine, diethylamine, tri-isopropanol amine and the like. They can be produced via any suitable process, leading to the formation of either "low 2-phenyl" or "high 2-phenyl" derivatives, though the "low 2-phenyl" derivatives are generally preferred. Such surfactants are commercially available from several suppliers globally, including Witco Corporation (One American Lane, Greenwich, Connecticut 06831), Stepan Company (Edens & Witnetka Rd, Northfield, Ill. 60093) and BASF Aktiengesellschaft (ESA/1550, D-67056 Ludwigshafen, Germany).

The detergent compositions according to the present invention are prepared with relatively low levels of active. Typically, compositions will comprise sufficient surfactant and solvent, as discussed hereinafter, to be effective as hard surface cleaners yet remain economical; accordingly they typically contain from about 0.5% to about 5% alkyl aryl sulfonate surfactant, more preferably from about 1% to about 4.5% alkyl aryl sulfonate surfactant, and even more preferably from about 1.2% to about 4% alkyl aryl sulfonate surfactant.

The alkyl aryl sulfonates of the invention have a chain length average of from about 8 carbon atoms to about 14 carbon atoms, more preferably from about 9 carbon atoms to about 13 carbon atoms, most preferably from about 9 carbon atoms to about 13 carbon atoms. The chain length distribution can vary from about 8 carbon atoms to about 16 carbons. Mixtures of linear and/or branched alkyl aryl benzene sulfonates are suitable.

Ammonium and sodium salts of $C_{11}$ to $C_{12}$ linear alkyl benzene sulfonates are most preferred in the context of the present invention. Examples of particularly preferred, commercially available sodium alkyl benzene sulfonates include Polystep A-13® available from Stepan, Calsoft L40® A slurry available from Pilot Chemical Company (11756 Burke Street, Santa Fe Springs, Calif.). and Witconate P1059® available from Witco Corporation (Greenwich, Conn.). Alternatively, the desired alkyl aryl sulfonate surfactant can be produced in-situ by neutralization of the corresponding alkyl aryl sulfonic acid. Examples of suitable alkyl aryl sulfonic acids include Biosoft100® available from Stepan Company, Calsoft LAS-99® available from Pilot Chemical, and Lutensit A-LABS® available from BASF AG in Germany.

B. The Non-ionic Alcohol or Cationic Surfactant

The detergent compositions of the present invention also preferably comprise one, or more nonionic alcohols, and/or cationic surfactants. The combination of the alkylaryl detergent surfactant with the alcohol and/or cationic surfactant is essential to the invention. Cleaning compositions comprising both nonionic alcohol and cationic surfactant can be employed. As used herein, "nonionic alcohol" means a linear or mono-branched nonionic alcohol comprising an average of from about 8 carbon atoms to about 16 carbon atoms, more preferably from about 9 carbon atoms to about 14 carbon atoms, most preferably from about 10 carbon atoms to about 13 carbon atoms. Examples of suitable nonionic alcohols include 2-butyl-1-octanol, 2-methyl-1-undecanol and dodecanol. Linear C10–13 nonionic alcohols are most preferred. Examples of preferred, commercially available nonionic alcohols include Neodol 1® and Neodol 23® available from Shell Chemical (1 Shell Plaza, Houston, Tex. 77252). It is believed that best results are achieved when the chain length of the nonionic alcohol most closely matches that of the alkyl aryl sulfonate surfactant. For this reason, nonionic alcohols comprising less than 8 carbon atoms or longer than 16 carbon atoms are not preferred in this invention. If present, the nonionic alcohol is present in effective concentrations not exceeding about 2%, more preferably in concentrations of 1.5% or less, most preferably in concentrations of 1.25% or less by weight of the composition.

Detergent compositions herein that do not contain a nonionic alcohol will normally contain one, or more, cationic surfactants. As used herein, cationic surfactants are those which at acidic pH behave substantially as cationic materials. The cationic surfactant is to creates viscosity via ion pairing with the alkyl aryl sulfonate surfactant disclosed hereinbefore. Cationic surfactants can also provide disinfectancy properties and can be selected so as to enhance such benefits. Preferred cationic materials have hydrophobic chain lengths of from about 8 carbon atoms to about 16 carbon atoms, more preferably from about 10 carbon atoms to about 16 carbon atoms, most preferably from about 12 carbon atoms to about 14 carbon atoms. Suitable cationic surfactants include quaternary alkyl and alkyl benzyl ammonium salts (e.g., Bardac® 208M from Lonza Incorporated, 1717 Route 208, Fairlawn, N.J. 07410), ethoxylated quaternary ammonium salts (e.g., Ethoquad® surfactants available from Akzo Nobel Chemicals, 300 South Riverside Plaza, Chicago, Ill.), ethoxylated amines (e.g., Ethomeen® surfactants available from Akzo Nobel Chemical), alkyl dimethyl betaines (e.g., Rewoteric AM DML-35® from Witco Corporation) or amido propyl betaines (e.g., Rewoteric AMB 15U® from Witco Corporation) and amine oxides (e.g., Barlox 10S® from Lonza Incorporated). Incorporation of quaternary ammonium surfactants is particularly preferred for compositions intended to deliver antibacterial, fungistatic and fungicidal properties. Quaternary ammonium surfactants are known in the art and include C10–16 alkyl trimethyl ammonium, C8–14 dialkyl dimethyl ammonium and C10–16 alkyl dimethylbenzyl ammonium derivatives and mixtures thereof Suitable and commercially available C10–16 alkyl trimethyl ammonium and C8–C 14 dialkyl dimethyl ammonium quaternaries are available from Witco corporation under the tradename Adogen®; suitable C10–16 alkyl dimethylbenzyl ammonium surfactants may be purchased from Lonza incorporated under the tradename Bardac®.

The level of cationic surfactant in the compositions of the present invention is preferably no greater than about 2%, more preferably no greater than about 1.5%, most preferably no greater than about 1.25% by weight of the composition. Cationic surfactants can be used alone or in combination with nonionic alcohols for viscosity. The level of cationic surfactant plus nonionic alcohol comprises at least about 0.3%, more preferably at least 0.4%, most preferably at least about 0.5%, and still more preferably from about 0.5% to about 2.0%, by weight of the composition.

C. The Hydrotropic Solvent

The compositions can also contain one or more hydrotropic solvents at effective levels, typically no less than about 2%, preferably from about 2% to about 8%, more preferably from about 2% to about to about 6%, most preferably from about 3% to about 6% by weight of the composition.

It is experimentally found that viscosity building requires the use of hydrotropic solvent. By hydrotropic solvent, it is meant an agent which helps solubilize the hydrophobic ingredients in the compositions. The hydrotropic solvent participates in the building of the viscosity and increases the stability of the composition. Such solvents typically have a terminal $C_3$–$C_6$ hydrocarbon attached to from one to three ethylene glycol or propylene glycol moieties. Examples of commercially available hydrotropic solvents based on ethylene glycol chemistry include ethylene glycol mono butyl ether (Butyl Cellosolve® available from Union Carbide, 39 Old Ridgebury road, Danbury, Conn.), diethylene glycol mono-butyl ether (Butyl Carbitol® available from Union Carbide), and mono-ethylene glycol n-hexyl ether (Hexyl Cellosolve® available from Union Carbide). Examples of commercially suitable commercially available hydrotropic solvents based on propylene glycol chemistry include the mono-, di-, and tri-propylene glycol derivatives of propyl and butyl alcohol, which are available from Arco Chemical, 3801 West Chester Pike, Newtown Square, Pa. 19073) and Dow Chemical (1691 N. Sweede Road, Midland, Mich.) under the trade names Arcosolv® and Dowanol®. The most preferred hydrotropic solvent is dipropylene glycol n-butyl ether, sold under the trade names Arcosolv DPNB® and Dowanol DPNB®. The amount of hydrotropic solvent can vary depending on the amount of other ingredients present in the composition, but should be present in concentrations of from about 2% to about 8%, more preferably from about preferably 2% to about 6%, most preferably from about 3% to about 5% by weight of the total composition.

In the absence of hydrotropic solvent, the compositions of the present invention often appear as milky, low viscosity mixtures which are often indefinitely stable at room temperature conditions. Addition of hydrotropic solvent serves to increase product viscosity to yield more translucent solutions. It is believed that the solvent dilutes the initially obtained phase and transforms it into predominantly flexible lamellar sheets dispersed in the aqueous solvent system. Cryogenic tunneling electron microscopy (hereinafter Cryo-TEM) measurements indicate that the phase chemistry consists of small concentric vesicles which become increasing flexible and more open ended lamellar sheets upon the addition of hydrotropic solvent.

D. The pH

For purposes of hard water stain removal, the compositions are acidic with a pH of from about 0.5 to about 6, more preferably from about 1.5 to about 5, still more preferably from about 2.0 to about 4. For removal of hard water stains, the pH is typically about 3 or less. Acidity is preferably accomplished through the use of one or more organic acids that have a pKa of less than about 6, preferably less than about 4. Such organic acids assist in phase formation as well as provide hard water stain removal properties. It is found that organic acids are very efficient in promoting good hard water removal properties within the framework of the compositions of the present invention. Lower pH and use of one or more suitable acids is also found to be advantageous for disinfectancy benefits. Examples of suitable organic acids include citric acid, benzoic acid, lactic acid, tartaric acid, glycolic acid, succinic acid, glutaric acid, adipic acid, gluconic acid and mixtures thereof. Such acids are readily available in the trade. Examples of more preferred acids include citric acid (available from Aldrich Corporation, 1001 West Saint Paul Avenue, Milwaukee, Wis.), benzoic acid (available from Aldrich Chemical) and a mixture of succinic, glutaric and adipic acids available from DuPont (Wilmington, Del.) sold as "refined AGS di-basic acids". Citric acid is most preferred. The amount of organic acid in the compositions herein can be from about 1% to about 10%, more preferably from about 2% to about 8%, most preferably from about 3% to about 6% by weight of the composition.

E. Optional Source of Peroxide

The compositions of the invention can contain peroxide such as hydrogen peroxide, or a source of hydrogen peroxide, for further disinfectancy, fungistatic and fungicidal benefits. Peroxide is believed to enhance the longevity of the benefit because of its well known residuality and slow decomposition to produce radical species. The components of the present composition are substantially compatible with the use of peroxides. Preferred peroxides include benzoyl peroxide and hydrogen peroxide. These can optionally be present in the compositions herein in levels of from about 0.05% to about 5%, more preferably from about 0.1% to about 3%, most preferably from about 0.2% to about 1.5%.

When peroxide is present, it is desirable to provide a stabilizing system. Suitable stabilizing systems are known. A preferred stabilizing system consists of radical scavengers and/or metal chelants present at levels of from about 0.01% to about 0.5%, more preferably from about 0.01% to about 0.25%, most preferably from about 0.01% to about 0.10%, by weight of the composition. Examples of radical scavengers include anti-oxidants such as propyl gallate, butylated hydroxy toluene (BHT), butylated hydroxy anisole (BHA) and the like. Examples of suitable metal chelants include diethylene triamine penta-acetate, diethylene triamine penta-methylene phosphonate, hydroxyethyl diphosphonate and the like.

Optional Surfactants and Solvents

In addition to alkyl aryl sulfonates and the hydrotropic solvents, the compositions of the present invention preferably comprise other additional anionic surfactants. Such surfactants typically comprise a hydrophobic chain containing from about 8 carbon atoms to about 18, preferably from about 10 to about 16, carbon atoms, and include a sulfate, sulfonate or carboxylate hydrophilic head group. Examples of suitable anionic surfactants include linear or branched alkyl sulfate detergent surfactant (e.g., Stepanol AM® from Stepan), paraffin sulfonates (Hostapur SAS® from Hoechst, Aktiengesellschaft, D-6230 Frankfurt, Germany), alkyl ethoxy carboxylates detergent surfactant (Neodex® from Shell Chemical Corporation), and the like. It is found that alkyl sulfate surfactants, in particular, are preferred as they offer improved soap scum cleaning benefits. In general, the level of optional anionic surfactants in the compositions herein is from about 0.5% to about 2%, preferably from about 0.6% to about 1%, by weight of the composition.

Nonionic detergent surfactants can also be present. Suitable nonionic detergent surfactants for use herein are alkoxylated alcohols generally comprising from about 6 to about 16 carbon atoms in the hydrophobic alkyl chain of the alcohol. Typical alkoxylation groups are ethoxy and/or propoxy groups. Such compounds are commercially available under the series Neodol® from Shell, or Lutensol® from BASF AG with a wide variety of chain length and alkoxylation degrees. Preferred nonionic detergent surfactants for use herein are according to the formula $R(X)_nH$, were R is an alkyl chain having from about 6 to about 16 carbon atoms, preferably from about 6 to about 10, X is an alkoxy group, preferably ethoxy, or a mixture of ethoxy and propoxy groups, n is an integer of from about 4 to about 30 preferably about 5 to about 8. Other non-ionic surfactants that can be used include those derived from natural sources such as sugars and include alkyl polyglucosides (e.g., Simusol® surfactants from Seppic Corporation, 75 Quai d'Orsay, 75321 Paris, Cedex 7, France) and N-alkyl glucose amide surfactants. If present, the concentration of nonionic surfactant is from about 0.1% to about 3%, more preferably from about 0. 1% to about 2%, by weight of the composition.

The compositions of the present invention can also include zwitterionic surfactants such as sulfobetaines and hydroxy sulfobetaines in effective concentrations preferably not exceeding about 2% by weight of the composition.

Other commercial sources of such surfactants can be found in McCutcheon's EMULSIFIERS AND DETERGENTS, North American Edition, 1997, McCutcheon Division, MC Publishing Company, also incorporated herein by reference.

The Aqueous Solvent System and Other Solvents

The compositions are in aqueous form, comprising at least about 60% aqueous solvent by weight of the composition, more preferably from about 60% to about 90% by weight of the composition. The aqueous solvent system can comprise low molecular weight solvents typically found in detergent compositions like ethanol, isopropanol, etc.

The compositions of the present invention can also include other solvents, and in particular paraffins, which have been found to substantially reduce the suds created by the composition.

Optional components, such as perfumes and other conventional adjuvants can also be present.

Optional Perfume and Additional Adjuvants

An optional, but highly preferred ingredient, is a perfume, usually a mixture of perfume ingredients. Indeed, perfume ingredients, which are typically hydrophobic materials, have been found to provide a contribution to building viscosity, perhaps through supporting the phase structure of the product, as well as improving the overall stability of the product. As used herein, perfume includes constituents of a perfume which are added primarily for their olfactory contribution.

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. The perfumes are preferably those that are more water-soluble and/or volatile to minimize spotting and filming. The perfumes useful herein are described in more detail in U.S. Pat. No. 5,108,660, Michael, issued Apr. 28, 1992, at col. 8 lines 48 to 68, and col. 9 lines 1 to 68, and col. 10 lines 1 to 24, said patent, and especially said specific portion, being incorporated by reference.

Perfume components can be natural products such as essential oils, absolutes, resinoids, resins, concretes, etc., and/or synthetic perfume components such as hydrocarbons, alcohols, aldehydes, ketones, ethers, acids, acetals, ketals, nitriles, etc., including saturated and unsaturated compounds, aliphatic, carbocyclic and heterocyclic compounds. Examples of such perfume components are: geraniol, geranyl acetate, linalool, linalyl acetate, tetrahydrolinalool, citronellol, citronellyl acetate, dihydromyrcenol, dihydromyrcenyl acetate, terpineol, terpinyl acetate, acetate, 2-phenylethanol, 2-phenylethyl acetate, benzyl alcohol, benzyl acetate, benzyl salicylate, benzyl benzoate, styrallyl acetate, amyl salicylate, dimenthylbenzylcarbinol, trichloromethylphenycarbinyl acetate, p-tert.butyl-cyclohexyl acetate, isononyl acetate, alpha-n-amnylcinammic aldehyde, alpha-hexyl-cinammic aldehyde, 2-methyl-3-(p-ter.butylphenyl)-propanal, 2-methyl-3(p-isopropylphenyl)propanal, 3-(p-tert.butylphenyl)propanal, tricyclodecenyl acetate, tricyclodecenyl propionate, 4-(4-hydroxy-4-methylpentyl)-3-cyclohexenecarbaldehyde, 4-(4-methyl-3-pentenyl)-3cyclohexenecarbaldehyde, 4-acetoxy-3-pentyl-tetrahhydropyran, methyl dihydrojasmonate, 2-n-heptyl-cyclopentanone, 3-methyl-2-pentyl-cyclopentanone, n-decanal, n-dodecanal, 9-decenol-1, phenoxyethyl isobutyrate, phenylacetaldehyde dimenthyl acetal, phenylacetaldehyde dicetyll acetal, geranonitrile, citronellonitrile, cedryl acetate, 3-isocamphyl-cyclohexanol, cedryl ether, isolongifolanone, aubepine nitrile, aubepine, heliotropine, coumarin, eugenol, vanillin, diphenyl oxide, hydroxycitronellal, ionones, methyl ionones, isomethyl ionones, irones, cis-3-hexenol and esters thereof, indane musks, tetralin musks, isochroman musks, macrocyclic ketones, macrolactone musks, ethylene brassylate, aromatic nitromusk. Compositions herein typically comprise from 0.1% to 2% by weight of the total composition of a perfume ingredient, or mixtures thereof, preferably from 0.1% to 1.0%. In the case of the preferred embodiment containing peroxide, the perfumes must be chosen so as to be compatible with the oxidant. In a preferred execution, the perfume ingredients are hydrophobic and highly volatile, e.g., ingredients having a boiling point of less than about 260° C., preferably less than about 255° C.; and more preferably less than about 250° C., and a ClogP of at least about 3, preferably more than about 3.1, and even more preferably more than about 3.2.

The logP of many ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The ClogP values, which are the most reliable and widely used estimates for this physicochemical property, are preferably used instead of the experimental logP values in the selection of the principal solvent ingredients which are useful in the present invention. Other methods that can be used to compute ClogP include, e.g., Crippen's fragmentation method as disclosed in J. Chem. Inf. Comput. Sci., 27, 21 (1987); Viswanadhan's fragmentation method as disclose in J. Chem. Inf. Comput. Sci., 29, 163 (1989); and Broto's method as disclosed in Eur. J. Med. Chem.—Chim. Theor., 19, 71 (1984).

The compositions herein can comprise a variety of other optional ingredients, including further actives and detergent builder, as well as mere aesthetical ingredients. In particular the rheology of the compositions herein would be suitable for suspending particles in the composition, e.g., particles of abrasives.

Detergent builders that are efficient for hard surface cleaners and have reduced filming/streaking characteristics at the critical levels are another optional ingredient. Preferred detergent builders are the carboxylic acid detergent builders described hereinbefore as part of the carboxylic acid disclosure, including citric and tartaric acids. Tartaric acid improves cleaning and can minimize the problem of filming/streaking that usually occurs when detergent builders are added to hard surface cleaners.

The detergent builder is present at levels that provide detergent building, and, if not part of the acid pH adjustment described hereinbefore, are typically present at a level of from about 0.1% to about 0.3%. more preferably from about 0.2% to about 2%, and most preferably from about 0.5 to about 1.0%.

Typically the improvement with regard to acceptable filming/streaking results occurs most when the builder is combined with amphoteric and/or zwitterionic detergent surfactant compositions although an improvement is also seen with the less preferred anionic or anionic/nonionic detergent surfactant compositions.

The compositions herein can also contain other various adjuncts which are known to the art for detergent compositions. Preferably they are not used at levels that cause unacceptable filming/streaking.

Non-limiting examples of other adjuncts are: enzymes such as proteases; hydrotropes such as sodium toluene sulfonate, sodium cumene sulfonate and potassium xylene sulfonate; thickeners such as xanthan gums, e.g., Keltrol, or Keltrol RD, typically at a level of from about 0.01% to about 2%, preferably from about 0.05% to about 0.5%; and aesthetic-enhancing ingredients such as colorants, providing they do not adversely impact on filming/streaking.

Antibacterial agents can be present, but preferably only at low levels to avoid filming/streaking problems. More hydrophobic antibacterial/germicidal agents, like orthobenzyl-para-chlorophenol, are avoided. If present, such materials should be kept at levels below about 0.1%.

Composition Making

The compositions herein can be made by mixing together all ingredients. In general, a preferred order of addition is to first incorporate water, alkyl aryl sulfonate surfactant and organic acid, followed by optional anionic, non-ionic and/or zwitterionic surfactants. The mixture is initially cloudy and becomes less opaque as hydrotropic solvent is added; the addition of hydrotropic solvent also results in a substantial increase in product viscosity resulting from the formation of more flexible and more open-ended vesicles and/or lamellar sheets. In most cases, addition of hydrotropic solvent causes the solution to become translucent or transparent. Once the solvent is added, pH is adjusted to optimum as desired by the formulator. Optional peroxide, perfume and dye can then be added. The compositions herein eventually reach a viscosity of from 50 cP to 200 cP, measured using a Brookfield viscometer at a 60 RPM shear rate with spindle #2.

As used herein, all numerical values are approximations based upon normal variations, all parts, percentages, and ratios are by weight unless otherwise specified, and all patents and other publications are incorporated herein by reference.

Experimental

Phase Chemistry by Cryo-TEM

Samples are prepared in a controlled environment vitrification system (CEVS) which is described in *J. Electron Microsc. Tech.*, 1988, 10, 87–111, said article being incorporated herein by reference. A 5 $\mu$l drop of the sample solution is placed on a carbon-coated polymer support film with holes in the film, said film being mounted on the surface of a standard 300-mesh TEM grid (Ted Pella, Inc., Catalog # 01883). The drop is blotted with filter paper until it is reduced to a thin film (10–200 nm) of the sample spanning the holes (2–8 $\mu$m) of the support film. The sample is then vitrified by rapidly plunging it through a synchronous shutter at the bottom of the CEVS into liquid ethane at its freezing point. The vitreous specimen is transferred under liquid nitrogen into a Philips CM12 microscope or a CM120 microscope with integrated bio-filter for imaging. The temperature of the sample is kept under −170° C. throughout the examination. Images are recorded either on Kodak SO-163 film or by a Gatan slow-scan CCD camera with Digital Micrograph software.

Soap Scum Cleaning

Standard soiled plates that are used to provide a reproducible, standard soiled surface are treated with each product and the surface is then wiped with a sponge using a Gardner Straight line Washability Machine. The number of strokes required for complete cleaning is measured and recorded. The soap scum cleaning index is calculated using the following equation: (# strokes for control product/# strokes for experimental product) * 100, where the control product is Mastro Lindo (Italy) and the experimental prototypes are compositions 1–8 disclosed herein. Indices greater than 100 are suggestive of products with superior soap scum removal properties.

Hard Water Cleaning

Four marble chips for each product tested of approximate dimensions ¾"×¾"×¼" are weighed to four decimal places using an analytical balance. The chips are then placed in 100 ml beakers containing 20 grams of product for a total of 10 minutes. The marble chips are then removed, rinsed and allowed to dry. They are then re-weighed and the weight lost is computed. Using averages of four trials for each product, the hard water removal index is computed as follows: (average weight loss of the marble chips immersed in the control product/average weight loss of the marble chips immersed in the experimental compositions) * 100.

EXAMPLES—EXPERIMENTAL DATA

The present invention is further illustrated by the following examples and data. The following compositions are made by mixing the listed ingredients in the listed proportions in the listed order of addition. Soap scum removal comparisons are made versus a commercially available product sold in Italy, Mastro Lindo, a product formulated at pH 3.7.

| Ingredient | Composition 1 | 2 | 3 | 4 | 5 | 6 | 7 | 8 |
|---|---|---|---|---|---|---|---|---|
| $C_{12}$ LAS* | 4.00 | 3.50 | 3.50 | 1.60 | 1.60 | 1.60 | 1.85 | 2.25 |
| $C_{12-14}$ Alkyl sulfate | — | — | — | 1.0 | 1.0 | 1.0 | 1.0 | 1.0 |
| $C_{12-13}$ Alcohol | — | — | — | 1.15 | 1.15 | 1.15 | 1.15 | 1.15 |
| $C_{12}$ Amine oxide | 0.70 | 0.70 | 0.70 | — | — | — | — | — |
| Bardac 208M ®** | — | — | — | — | — | — | — | 0.20 |
| n-BPP*** | — | 2.0 | 5.0 | 4.0 | 4.0 | 4.0 | 4.0 | 4.0 |
| Citric acid | 4.0 | 4.0 | 4.0 | 4.5 | 4.5 | 4.5 | 4.5 | 4.5 |
| Ammonia | 0.43 | 0.43 | 0.43 | 0.29 | 0.29 | 0.29 | 0.29 | 0.23 |
| $C_{12}$ Paraffin | — | — | — | 0.75 | 0.75 | — | 0.75 | — |
| Hydrogen peroxide | — | — | — | — | 1.5 | — | — | 0.25 |
| Perfume | 0.5 | 0.5 | 0.5 | 0.5 | 0.5 | 0.5 | 0.5 | 0.5 |
| pH | 3.7 | 3.7 | 3.7 | 3.1 | 3.1 | 3.0 | 3.0 | 3.0 |
| Viscosity, cP | 20 | 50 | 120 | 90 | 80 | 80 | 100 | 140 |
| Lamellar sheet phase? | No | No | Yes | Yes | Yes | No | No | Yes |
| Soap Scum Removal index | † | — | 110 | 125 | 125 | 60 | 60 | 125 |
| Hard Water Removal | — | — | — | 400 | 400 | — | — | 200 |

*LAS: $C_{12}$ Linear alkyl benzene sulfonate (Calsoft L-40 ®from Pilot)
**Bardac 208M ® is a mixture of quaternary ammonium surfactants sold by Lonza, Incorporated.
***n-BPP: Dipropylene glycol n-butyl ether (Dowanol DPnB ® by Dow Chemical)
† Composition does not fully remove soap scum Data Analysis All of the compositions include a $C_{12}$ alkyl benzene sulfonate as the anionic surfactant of choice, and all but composition 1 include the required hydrotropic solvent. Compositions 1, 2 and 3 illustrate the impact of hydrotropic solvent on phase chemistry and on product viscosity. Unlike conventional products, the hydrotropic solvent (n-BPP) increases product viscosity by transforming concentric vesicular structures into flexible lamellar sheets. The result is an improvement in soap scum cleaning.

The phase chemistry and viscosity of compositions 4–8 is built using long chain alcohols instead of cationic surfactant. Composition 4 and 5 exhibits a flexible lamellar phase structure, while the phase structure of compositions 6 and 7, which are chemically very similar to composition 5, consist of concentric vesicles. Differences in cleaning performance between compositions 6 and 7, and compositions 4 and 5 are attributed to differences in phase chemistry.

Composition 8 uses the combination of long chain alcohol plus quaternary ammonium surfactant to create a high viscosity product comprised of flexible lamellar sheets. Note that this composition additionally contains peroxide, has high viscosity and exhibits excellent soap scum cleaning performance.

Hard water testing was limited to products displaying the strongest results in the soap scum test. Note that all three of the preferred compositions have excellent hard water removal properties.

What is claimed is:

1. An aqueous viscous hard surface detergent containing a flexible lamellar sheet phase, which comprises:

a. from about 1% to about 5% alkyl aryl sulfonate detergent surfactant;

b. from about 0.3% to about 2% nonionic alcohol and/or cationic surfactant;

c. from about 1% to about 8% of one, or more, hydrotropic solvents;

d. optionally, an effective amount, up to about 5%, of peroxide; and e. the balance an aqueous solvent system, said composition having a pH from about 0.5 to about 6 and a viscosity of from about 50 cP to about 200 cP, measured using a Brookfield viscometer at a 60 RPM shear rate with spindle #2.

2. A composition according to claim 1 which comprises (a) from about 1% to about 4.5% by weight of the composition of alkyl aryl sulfonate surfactant; (b) from about 0.4% to about 1.5% by weight of the composition of said nonionic alcohol and/or cationic surfactant; from about 2% to about 6% of one, or more, hydrotropic solvents; up to about 5% by weight of the composition of said peroxide which is hydrogen peroxide; and from about 60% to about 90% by weight of the composition of said aqueous solvent system, said composition having a pH of from about 1.5 to about 5.

3. A composition according to claim 2 which comprises from about 1.2% to about 4% alkyl aryl sulfonate surfactant; (b) from about 0.5% to about 1.25% by weight of the composition of said nonionic alcohol and/or cationic surfactant; from about 3% to about 6% of one, or more, hydrotropic solvents; from about 0.05% to about 3% by weight of the composition of said hydrogen peroxide; and from about 60% to about 90% by weight of the composition of said aqueous solvent system, said composition having a pH of from about 2.0 to about 4.

4. A composition according to the claim 3 wherein said alkylaryl sulfonate detergent surfactant is an alkylbenzene sulfonate wherein said alkyl group contains from about 8 to about 14 carbon atoms.

5. A composition according to the claim 2 wherein said alkylaryl sulfonate detergent surfactant an alkylbenzene sulfonate wherein said alkyl group contains from about 8 to about 14 carbon atoms.

6. A composition according to the claim 5 wherein said nonionic alcohol is a linear, or mono-branched alcohol containing from about 8 to about 16 carbon atoms and/or wherein said cationic surfactant contains a hydrophobic chain containing from about 8 to about 16 carbon atoms.

7. A composition according to the claim 2 wherein said nonionic alcohol is a linear, or mono-branched alcohol containing from about 8 to about 16 carbon atoms and/or wherein said cationic surfactant contains a hydrophobic chain containing from about 8 to about 16 carbon atoms.

8. A composition according to claim 7 wherein said cationic surfactant is selected from the group consisting of a $C_8$ to $C_{14}$ dialkyl dimethyl ammonium surfactants, $C_{10}$–$C_{16}$ alkyl trimethyl ammonium surfactants, $C_{10}$–$C_{16}$ alkyl dimethyl benzyl ammonium surfactants, and mixtures thereof.

9. A composition according to claim 8 wherein hydrogen peroxide is present in levels from about 0.05% to about 3%.

10. A composition according to claim 9 wherein said peroxide is hydrogen peroxide.

11. A composition according to the claim 1 wherein said alkylaryl sulfonate detergent surfactant is an alkylbenzene sulfonate wherein said alkyl group contains from about 8 to about 14 carbon atoms.

12. A composition according to the claim 11 wherein said nonionic alcohol is a linear, or mono-branched alcohol containing from about 8 to about 16 carbon atoms and/or wherein said cationic surfactant contains a hydrophobic chain containing from about 8 to about 16 carbon atoms.

13. A composition according to claim 11 wherein said cationic surfactant is selected from the group consisting of a C8 to C14 dialkyl dimethyl ammonium quaternary surfactants, $C_{10}$–$C_{16}$ alkyl trimethyl ammonium surfactants, $C_{10}$–$C_{16}$ alkyl dimethyl benzyl ammonium surfactants, and mixtures thereof.

14. A composition according to claim 11 wherein said hydrotropic solvent contains a hydrocarbon moiety containing from about 3 to about 6 carbon atoms attached to from about 1 to about 3 ethylene and/or propylene oxide moieties.

15. A composition according to claim 1 wherein said hydrotropic solvent contains a hydrocarbon moiety further comprising from about 3 to about 6 carbon atoms attached to from about 1 to about 3 ethylene and/or propylene oxide moieties.

16. A composition according to claim 1 containing citric acid as a pH adjuster and having a pH of about 3 or less.

17. The process of cleaning a surface comprising applying an effective amount of the composition of claim 1 to said surface and rinsing said surface.

18. The process of claim 17 wherein said surface is soiled with mildew and said composition contains an effective amount of hydrogen peroxide.

* * * * *